United States Patent [19]

Bopst, III

[11] 4,373,987

[45] Feb. 15, 1983

[54] ANGLE-ATTACHMENT STABILIZING UNIT

[76] Inventor: John H. Bopst, III, 409 Chalfonte Dr., Baltimore, Md. 21228

[21] Appl. No.: 307,365

[22] Filed: Oct. 1, 1981

[51] Int. Cl.[3] ..... B44C 7/02; D06F 75/32

[52] U.S. Cl. ..... 156/574; 156/577; 156/579; 156/583.1; 219/245; D8/355

[58] Field of Search ..... 156/574, 577, 579, 583.91, 156/583.1, 583.6, 582, 523, 515, 363; 219/246, 245, 259; 221/156; D8/106, 355

[56] References Cited

U.S. PATENT DOCUMENTS

| | | | |
|---|---|---|---|
| 2,533,209 | 12/1950 | Ames | 156/582 |
| 3,047,047 | 7/1962 | Winberg | 156/583.6 |
| 3,536,569 | 10/1970 | Gosnell | 156/577 |
| 3,829,347 | 8/1974 | Honea | 156/577 |
| 4,248,659 | 2/1981 | Bopst | 156/574 |

FOREIGN PATENT DOCUMENTS

| | | | |
|---|---|---|---|
| 488756 | 1/1938 | United Kingdom | 219/246 |

*Primary Examiner*—Edward C. Kimlin
*Assistant Examiner*—Louis Falasco
*Attorney, Agent, or Firm*—John F. McClellan, Sr.

[57] ABSTRACT

A stabilizing improvement for a manually operated system employing a heated "V"-section soleplate attachment for applying a heat-sealing tape along the interior joint between wall panels set at right angles to each other, provides first and second contacts located respectively in the planes of but spaced from the "V"-section soleplate attachment, for guiding on the wall panels to give greater stabilizing leverage for more uniform application of tape; resilient mounting of a member carrying the contacts and screw adjustment of the member are disclosed.

2 Claims, 3 Drawing Figures

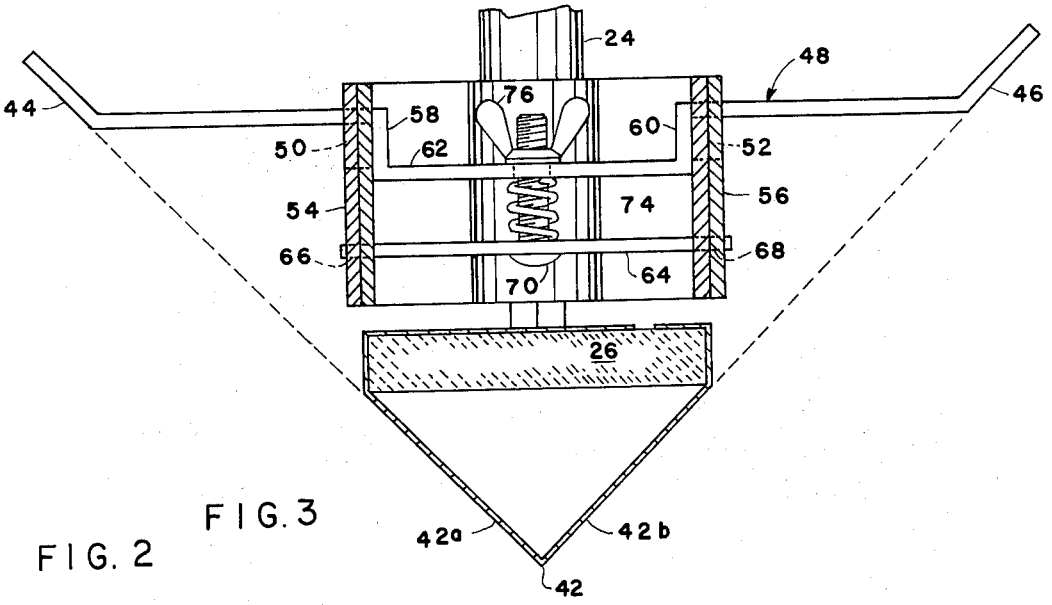
FIG. 3
FIG. 2
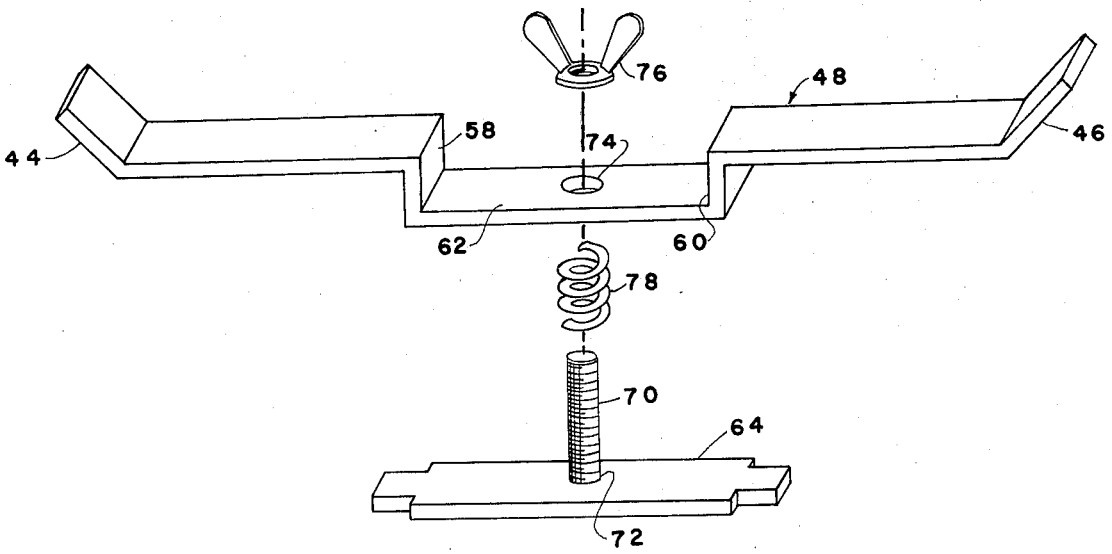

ANGLE-ATTACHMENT STABILIZING UNIT

CROSS-REFERENCE TO RELATED APPLICATION

Cross-reference is made to my copending U.S. Patent Application Ser. No. 222,387 filed, Jan. 5, 1981 now U.S. Pat. No. 4,330,355, for System for Control-LED and Immediate Sealing of Structural Joints and Plaster Line Cracks for which System the present application discloses a stabilizing accessory.

BACKGROUND OF THE INVENTION (1) Previously disclosed art: My co-pending application which is incorporated and made a part hereof, discloses a system which, when manually propelled along a joint between wall panels, covers the joint with heat-sealable metallic tape heated by an electric soleplate of the system and which by means of locking the tape feed stops itself, preventing further propulsion, at exactly the right distance from a ceiling or floor, or other termination of the joint so that the tape, when plunger-cut using a provision of the system, will just extend to the ceiling or floor or other termination of the joint, and no more; for the purpose, the tape feed is locked by a sensor arm when the sensor arm strikes a ceiling or floor or other obstacle at the termination of the joint; a graduated adjustment provides for calibration of the system. An embodiment of the invention provides a special "V" shaped sole plate attachment which adapts it for applying heat sealing tape to joints between panels meeting at right angles, or 90° joints, and that is the embodiment to which the present invention is directed.

(2) The improvement of the present invention: because the "V" bottom of the soleplate attachment is heated and should extend little, if any, beyond the edges of the tape to be heated, the width of the arms or flats of the "V" is necessarily limited. The relatively small "V" soleplate attachment may require some skill to keep in balanced or uniform contact with the two faces of the tape which is applied like a "V" trough in the 90° joint, pressures into the "V" trough and along it being simultaneously required.

According to the present invention first and second adjustable contacts for guiding are disclosed to align with the soleplate attachment and stabilize it in the "V" trough, with the objects of providing greater aligning leverage and easier operation in an economical, efficient and light weight embodiment.

BRIEF SUMMARY OF THE INVENTION

In brief summary given as cursive description only and not as limitation, the invention includes an improvement in the guiding of heated "V"-section soleplate configuration for sealing tape in a "V"-section junction between first and second wall panels and the like, the improvement including first and second contacts that guide on the respective first and second wall panels, and means for adjustably maintaining said contacts at leverage-providing locations in extensions of the respective planes of the "V"-section soleplates configuration.

BRIEF DESCRIPTION OF THE DRAWINGS

The above and other objects and advantages of this invention will become more readily apparent on examination of the following description, including the drawings in which:

FIG. 2 is an exploded perspective view; and

FIG. 3 is a front elevational sectional detail taken at 3—3, in FIG. 1.

DETAILED DESCRIPTION

Figure 1:
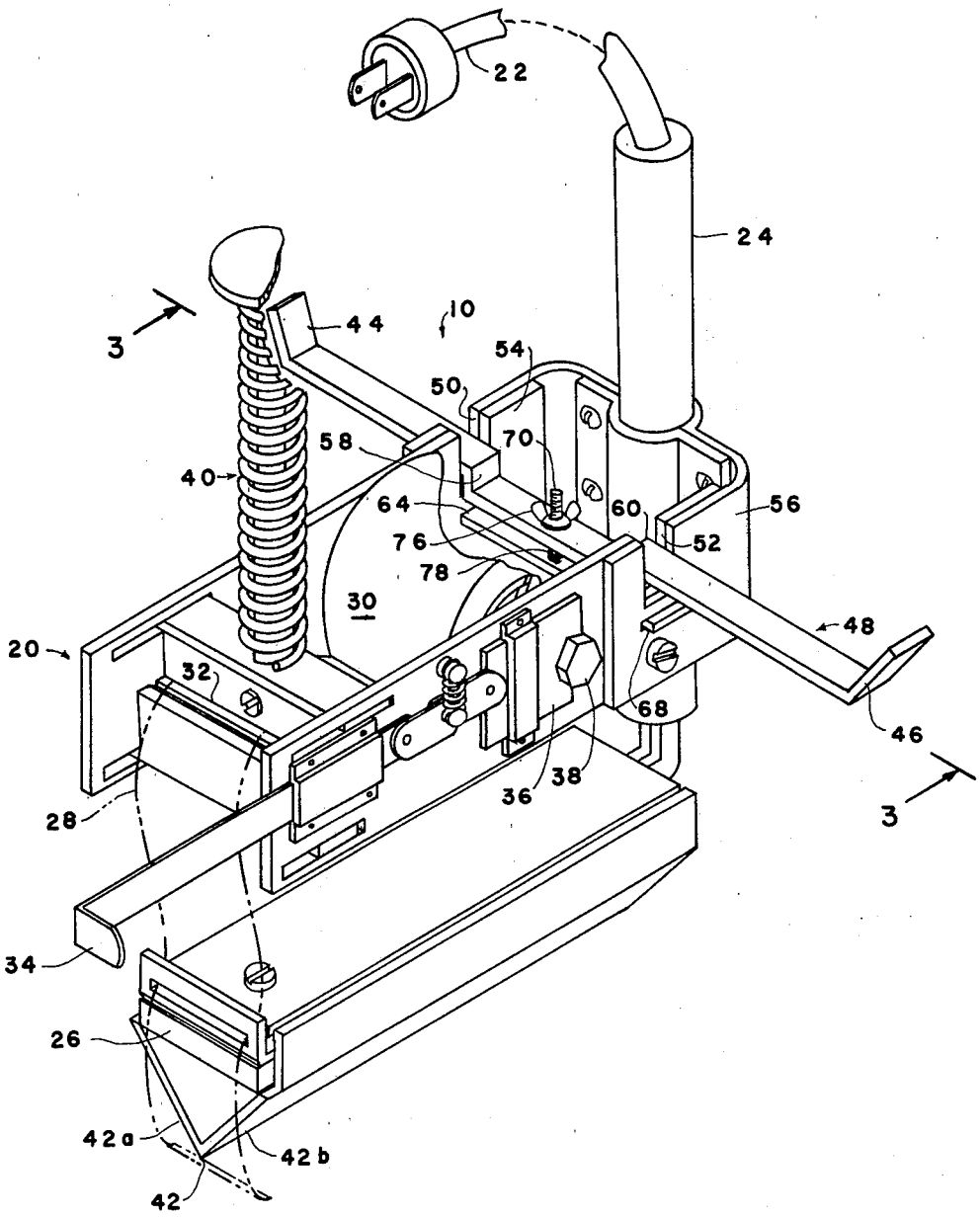
FIG. 1 is an overall perspective view.

FIG. 1 shows the invention 10, an improvement on the basic tape applying unit 20.

PREVIOUSLY DISCLOSED MECHANISM

The basic tape applying unit 20 includes a lead 22 from a source of electricity, which passes through the manually gripped handle 24 and then forwardly into a soleplate 26 heated by resistance. A "V"-section soleplate angle attachment to the soleplate permits tape 28 from roll 30, to be applied on an interior corner joint between wall panels or the like and heated to reactivate conventional heat-reactivatable adhesive on the tape and secured under pressure of the soleplate which fits the joint, usually a right-angle or 90° joint. A further feature of the unit to which the present invention is applied is an automatic tape measurer to insure that the right amount of tape is dispensed, and no more, before the tape is cut by cutter mechanism 32.

When a ceiling or the like is approached, sensor arm 34 depresses on contact with it and locks tape spindle by means of a set of jaws 36 that engages the hex-head 38 on the end of the tape spindle, stopping feeding of tape and thus stopping advance of the tape-applying unit 20.

The tape is then cut by manual depression of guillotine type plunger 40 which actuates the cutter. Sensor arm 34 then resiliently collapses permitting the tape applying unit to be advanced along the joint until it hits the walls and tape laying stops, the predetermined length cut just reaching the ceiling.

THE PROBLEM

The tape applying unit must sometimes be used with an extension handle or on a ladder and the relatively narrow first **42*a* and second 42*b* planar portions of the "V"-shaped soleplate attachment 42** although conforming to first and second adjacent wall panels adjacent the vertex of the "V"-shape, may tend to press on one side harder than the other because the arms of the "V" are relatively short, an inch or two (2.5 cm) being about the maximum aim width necessary for tape sizes usually contemplated.

THE INVENTION

FIGS. 1, 2 and 3 are now referred-to together. The invention 10 includes means for guiding respectively on the first and second wall panels described, in the form of first and second ends 44, 46 on a preferably symmetrical member 48 transverse to the direction of advance of the tape laying unit. These ends 44, 46 lie in respective planes defined by the "V"-shaped soleplate attachment 42 at **42*a*, 42*b* and contact the wall panels at locations spaced from it and considerably farther apart than the greatest distance across the "V"-shape of the soleplate attachment, giving considerably greater leverage and thus stability to the tape applying unit 20** when in operation.

The ends 44, 46 preferably are upturned as shown and diverge, forming a suitable angle, in this case a right-angle, between them. They may, of course, be downturned and converge or may be straight extensions of the member 48, but a broad-area and non-scarring contact is preferred. To provide maximum visual access at the front of the tape-laying unit, and to provide close support adjacent the handle 24 the guiding means installation 10 is preferably near the rear of the "V" section soleplate attachment.

The invention provides means for self-aligning the guiding means 44, 46 so that they seek and remain in the wall panel planes with the "V" shaped soleplate attachment 42 and for preventing the guiding means from unwanted twisting or rotating. This provision includes means for resiliently equalizing pressure on the guiding means.

The member 48 has a width proportioned for slidably fitting in upright slots 50, 52 in the opposed walls 54, 56 of the tape applying unit 20. An angle 58, 60 at either side of the central portion of the member 48 forms a depressed center in it so that this angled middle portion 62 slidably fits between the opposed walls 54, 56.

Retaining and resiliently biasing the member 48 away from the soleplate is an assembly including screw holding plate 64 secured between the walls 54, 56 in slots 66, 68, a headed screw 70 passing up through a hole 72 (FIG. 2) in the screw holding means, and through a corresponding hole 74 in member 48, and a wing nut 76 on the screw which adjustably forces the member 48 down against compression spring 78 on the screw between holding means 64 and the member 48. The spring force tends to force member 48 square against the underside of the nut 76 and thus hold the ends 44, 46 in proper location. The outer portions of the flat strap material making up the member 48 may be somewhat resilient, tending to equalize loading and accommodate irregularities in wall panels, so that the feature is a means for resiliently equalizing pressure.

Material for the member 48 may be resilient steel, 1/16 inch (0.6 cm) thick by 7/16 inch (0.45 cm) wide. Tip-to-tip the member 48 may measure 9 inches (923 cm).

From the above it will be appreciated that the slots 50, 52 prevent the member 48 from rotating about the screw axis and about the length of the member 48 and the resilient self-alignment bias of the member 48 against the nut 76 can tend to equalize forces on the ends 44, 46 while urging the member 48 to a stabile position in rotation about the long axis of the tape applying unit 20. It will be appreciated that the sole plate can be "V" shaped rather than have a "V"-shaped attachment.

Finally, the prior disclosure adjustment feature indicated by the double walls of the slots need not be employed with the present invention; these walls can be single and unitary from the handle 24 forward.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for stabilizing a "V"-section soleplate attachment of a manually advanced tape-applying unit as said tape applying unit is in operation applying tape and with said "V"-section soleplate attachment heat sealing tape along a joint in an interior corner formed by first and second wall panels, the "V"-section soleplate attachment including first and second planar portions for conforming respectively to the first and second wall panels on either side of the vertex of said "V"-section, the improvement comprising: means on said tape applying unit for guiding on said first and second wall panels, means for adjustably aligning said guiding means on said first and second wall panels in predetermined relation to the "V"-section soleplate attachment; the predetermined relation being with the means for guiding in-plane with the respective first and second planar portions and spaced therefrom in a direction away from said joint; the means for guiding including a member generally transverse to the direction of said advance and having thereon first and second ends for contacting respective wall panels, the first and second ends spaced apart a distance greater than the greatest distance across said "V"-section; said first and second ends being planar ends and forming a right angle between them, said first and second ends diverging from each other, and the means for adjustably aligning including means on said member for resiliently equalizing pressure on said guiding means during said operation.

2. In a system as recited in claim 1, said means for resiliently equalizing pressure including means for movably engaging said member with a said tape applying unit, including means for preventing a rotation of said member, means for biasing said member away from said "V"-section soleplate attachment and means for adjusting said biasing; the means for movably engaging said member with a said tape applying unit including the tape applying unit having opposed walls with respective slots therein, said member slidably fitting in said slots and having an angled middle portion movable relative to said opposed walls, a screw and nut assembly, means holding the screw to the tape applying unit with a portion of the screw passing through a hole in said member, a compression spring on said screw between said holding means and member, said nut adjustably pressing the member against the compression spring, the holding means comprising a plate with ends, and said plate ends held in respective slots in said opposed walls.

* * * * *